United States Patent [19]

Culpepper, Jr. et al.

[11] 4,081,939

[45] Apr. 4, 1978

[54] SIDING PANEL BACKERBOARD AND METHOD OF MANUFACTURING SAME

[75] Inventors: Bertram C. Culpepper, Jr., Linden; Richard C. Wilson, Troy, both of Mich.

[73] Assignee: Culpepper & Associates, Inc., Fenton, Mich.

[21] Appl. No.: 809,902

[22] Filed: Jun. 24, 1977

Related U.S. Application Data

[63] Continuation of Ser. No. 657,190, Feb. 11, 1976, Pat. No. 4,033,802.

[51] Int. Cl.[2] ..... E04D 1/10

[52] U.S. Cl. ..... 52/535; 52/555

[58] Field of Search ..... 52/518, 519, 522, 521, 52/531, 535, 555, 520

[56] References Cited

U.S. PATENT DOCUMENTS

| | | | |
|---|---|---|---|
| 2,535,620 | 12/1950 | Alvarez | 52/472 |
| 3,159,943 | 12/1964 | Sugar et al. | 52/408 |
| 3,214,876 | 11/1965 | Mattes | 52/520 |
| 3,304,676 | 2/1967 | Sallie et al. | 52/531 |
| 3,307,306 | 3/1967 | Oliver | 52/420 |
| 3,434,259 | 3/1969 | Corbin | 52/420 |
| 4,033,802 | 7/1977 | Culpepper et al. | 52/521 |

*Primary Examiner*—James L. Ridgill, Jr.
*Attorney, Agent, or Firm*—Basile and Weintraub

[57] ABSTRACT

A backerboard for use in conjunction with a siding panel of the type having longitudinally disposed walls connected by a longitudinal step and wherein the siding panel is normally fastened to the external wall sheathing of a building. The backerboard is adapted to be disposed between the inner surfaces of the siding panel walls and the exterior of the building sheathing. The backerboard is fabricated from two polystyrene foam plastic members that are disposed with respect to each other so as to have overlapping portions that are bonded to one another by a suitable adhesive such that the longitudinal side edge of one of the members adjacent the overlapping portions is contoured to snugly abut the step of the siding panel when the backerboard is positioned against the same. A method for manufacturing the backerboard is disclosed.

7 Claims, 6 Drawing Figures

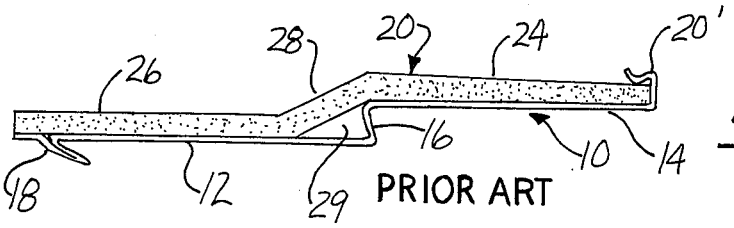
Fig-1
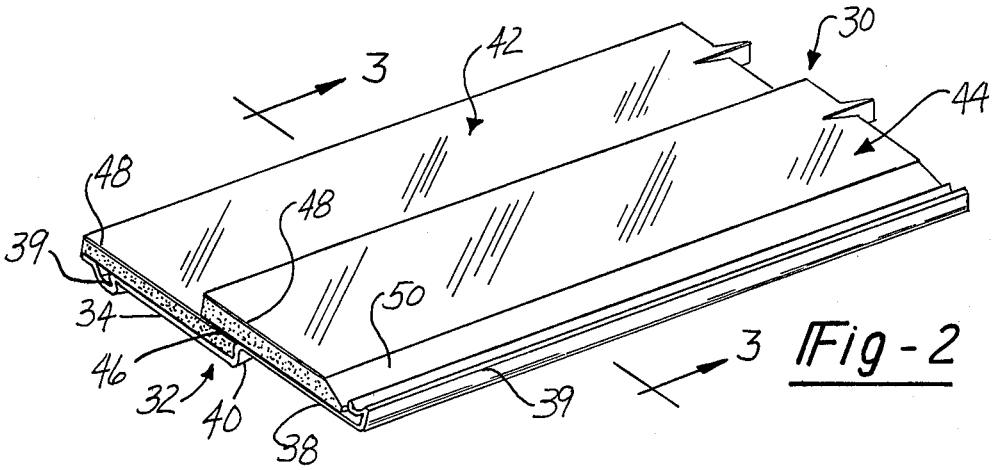
Fig-2
Fig-3
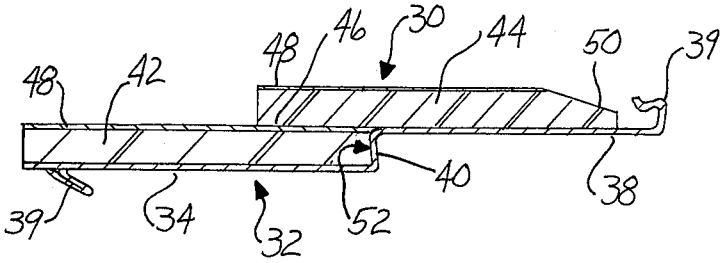
Fig-4
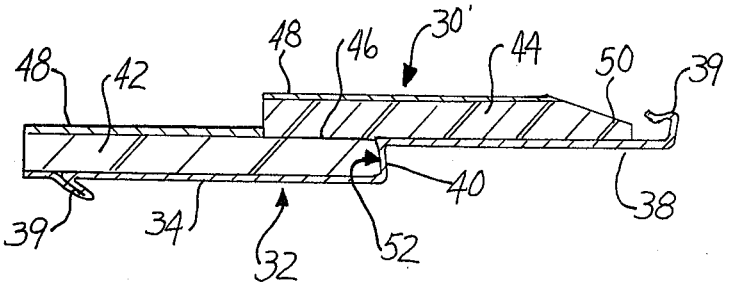

SIDING PANEL BACKERBOARD AND METHOD OF MANUFACTURING SAME

This is a continuation of application Ser. No. 657,190 filed Feb. 11, 1976, now U.S. Pat. No. 4,033,802 issued July 5, 1977.

BACKGROUND OF THE INVENTION

I. Field of the Invention

The present invention relates broadly to composite structural siding panels and, more particularly, to a backerboard having insulating qualities and adapted to be disposed between the inner surfaces of the siding panel and the exterior wall of a building structure.

II. Description of the Prior Art

Heretofore siding panels for buildings have been constructed of various material, such as aluminum, steel, or vinyl, manufactured in long panels of approximately 12 feet, 6 inches. The long panels are fastened horizontally in overlapping relationship to the wall of the building and, in some instances, have been applied directly over existing structures or over a sheathing of a standard type, such as Celotex or the like. It is becoming a common commercial practice to laminate the siding panel with an insulating material in the nature of a foam or rigid polystyrene or the like. Examples of such siding panels are disclosed in U.S. Pat. Nos. 2,535,620; 3,159,943; and 3,214,876. All of these structures have one thing in common; that is, the construction of the siding panel is in the form of a flat surface with outer edges contoured so as to provide for the mating attachment of the individual horizontally disposed panels. However, when siding panels of the Double-4 or Double-5 type, such as disclosed in U.S. Pat. No. 3,157,965, are desired to be used, the flat sheet of insulating material of the type disclosed in the aforementioned patents is not appropriate.

As can be seen in FIG. 1 of the drawings, an example of the prior art is illustrated in the form of a cross-sectional view of a Double-4 siding panel 10 which is formed of an aluminum material and has walls 12 and 14 separated by a step 16, while the parallel lengthwise edges 18 and 20' are contoured so as to define sections which are utilized to attach the siding panels to the building structure in a conventional manner. In order to provide an insulating backerboard, the prior art has devised a backerboard 20 of the type disclosed in FIG. 1 which consists of an integral member having first and second longitudinal walls 24 and 26 interconnected by an inclined wall 28. It can easily be seen upon inspection of FIG. 1 that an air space 29 is formed between the backerboard 20 and the siding panel 10 in the area associated with the step 16. This air space 29 may result in an unwanted accumulation of moisture and/or insects and the like.

As aforementioned, it is conventional for siding panels to be fabricated in full lengths of approximately 12 feet, 6 inches; however, the existing prior art insulating backerboard 20 may not be fabricated in lengths exceeding 75 inches. This is due to the present methods of manufacturing. Generally, a wire cutting method is employed in the manufacture of the prior art backerboard 20, and the same may not be made in an accurate and acceptable manner in lengths in excess of 75 inches.

Because of the contour of the prior art backerboard 20 and its non-uniform lengths, it is necessary that it be attached to the siding panel 10 at the building site, thus, necessitating the need for double shipments. It would be preferable and more economical to laminate the backerboard 20 to the siding panel 10 at the respective siding manufacturer's plant; however, it can be seen that the stacking of the siding panel 10 one upon the other would result in cracking or otherwise damaging the inclined section 28 of the backerboard 20. Additionally, the fact that the prior art backerboard 20 may not be fabricated in lengths in excess of 75 inches, an attempt to laminate two pieces of backerboard 20 to the siding panel 10 in an implant process has proved to be uneconomical.

SUMMARY OF THE INVENTION

The present invention, which will be described in greater detail hereinafter, comprises a backerboard adapted for use in conjunction with siding panels wherein the backerboard comprises two longitudinal members having overlapping portions which are bonded to each other to define a surface contour which is complementary to the surface contour of the inner wall of the siding panel on which the backerboard abuts. A method of manufacturing the backerboard is disclosed.

It is therefore an object of the present invention to provide a backerboard for siding panels wherein the backerboard is fabricated from an insulating material in the nature of a polystyrene plastic or the like.

It is another object of the present invention to provide a backerboard of the type described which may be fabricated in the lengths comparable to the length of conventional siding panels and which may be attached to the siding panels in an implant operation, as the backerboard is of sufficient strength to permit the stacking of the laminated metal siding panels one upon the other without damage to the backerboard.

It is also an object of the present invention to provide such a siding of the lap siding type suitable for buildings of both single and double constructed types, wherein a laminated structure provides a structural strength compared to much heavier gauge materials, thereby providing an insulated siding at a reasonable cost.

It is a further object of the present invention to provide a backerboard for siding panels which is characterized by simplicity of structure and ecomony of manufacture.

It is still a further object of the present invention to provide a method for fabricating the backerboards of the type disclosed.

Further objects, advantages, and applications of the present invention will become apparent to those skilled in the art of backerboards for siding panels when the accompanying description of one example of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein:

FIG. 1 is a cross-sectional view through a siding panel having a backerboard carried thereon for purposes of illustrating the prior art structure;

FIG. 2 is a fragmentary perspective view of a siding panel having a backerboard constructed in accordance with the principles of the present invention;

FIG. 3 is a cross-sectional view of the backerboard and siding panel taken along Line 3–3 of FIG. 2;

FIG. 4 is a cross-sectional view of a modification of the backerboard illustrated in FIGS. 2 and 3 with the siding panel removed;

DESCRIPTION OF THE PREFERRED EMBODIMENT

Figure 5:
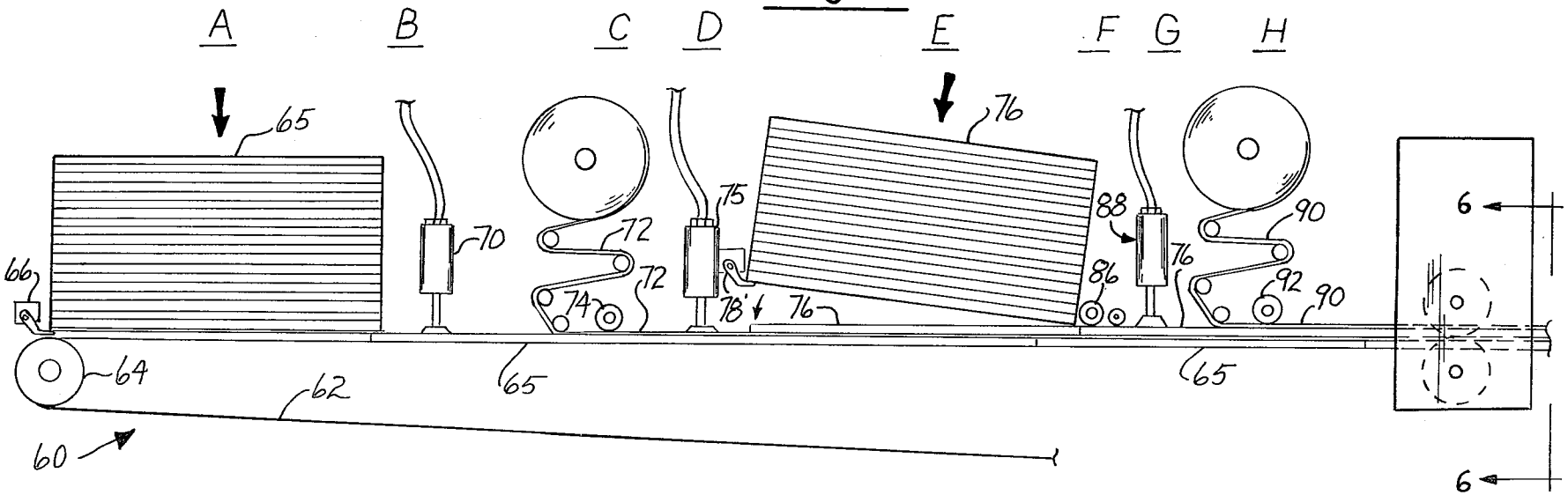
FIG. 5 is a schematic illustration of the preferred method for fabricating the backerboard illustrated in FIGS. 2, 3, and 4 of the drawings.

Referring now to the drawings and, in particular, to FIGS. 2, 3, and 4 wherein there is illustrated one example of the present invention in the form of a backerboard 30 attached to the inside surfaces of a siding panel 32. The siding panel 32 is conventional in construction and is generally referred to as a Double-4 or Double-5 siding panel. The panel 32 comprises a sheet material, such as aluminum, steel, or vinyl, that may be coated with a protective finish, such as baked enamel. The sheet material is formed to have laterally spaced walls 34 and 38 connected by a vertical wall member 40 substantially as described hereinbefore with respect to the description of the siding 10 in the discussion of the prior art. The opposite lengthwise side edges of the siding panel 32 are shaped to define means 39 for connecting adjacent horizontally disposed siding panels 32 to each other and to the sheathing of the building on which they are adapted to cover and protect, all of which is conventional and well known to those skilled in the art of siding panel construction. The siding panels 32 and the backerboards 30 may be attached directly to the building studs, as desired.

The backerboard 30 comprises two longitudinal members 42 and 44 which have overlapping portions that are bonded to each other at 46, in a manner which will be described in greater detail hereinafter. The members 42 and 44 are formed in lengths of approximately 12 feet, 4 inches, to correspond to the conventional length of the siding panels 32; and each is approximately ½ inch in thickness having a total combined width of approximately 8½ inches in the embodiment illustrated. The overall width, however, will vary to accommodate the contour of the inner walls of the siding panels 32.

It should also be noted that in the preferred embodiment the exposed surfaces of the longitudinal members 42 and 44 are coated with an aluminum foil 48, or the like, to provide increased insulation characteristics in the backerboard 30. The tapered upper side edge 50 of the member 44 has a lengthwise taper to facilitate the assembly of adjacent siding panels 32 as the same are fastened to the building structure. While the backerboard 30 is illustrated with a tapered upper side edge 50 which is spaced from the end 39 of siding panel 32, the tapered edge 50 of the backerboard 30 may abut the panel end 39 or may be made without a taper and spaced inwardly from the panel end 39. The longitudinal members 42 and 44 which comprise the backerboard 30 are preferably fabricated from a foam plastic, such as a polystyrene, polyurethane, or the like. Materials should be of such desired rigidity as to perform the desired function, all of which is well known to those skilled in the art.

It should be noted that, because of the utilization of two separate members 42 and 44 to form the backerboard 30, a square corner is formed at 52 along the lengthwise edge of the member 42 where the same is in abutment with the bottom surface of the member 44. This permits a snug abutment of the edge 52 with the inside surface of the connecting wall 40 to thereby completely eliminate the air space which is a substantial problem with the prior art backerboard 20 illustrated in FIG. 1.

The board members 42 and 44 are secured to each other at 46 by an appropriate adhesive, such as Nyabond #LP-0076 or other well-known adhesives and bonding materials which are preferably anti-corrosive.

While the backerboard 30 may be shipped to the construction site to be inserted onto the back side of the metal siding panel 32 as the same are being installed on the exterior surface of a building in a manner similar to the use of the prior art backerboard 20, it is preferred and more economical to employ the present invention by laminating the backerboard 30 to the inner wall surfaces of the panel 32 at the siding panel manufacturer's plant. This can be accomplished since the laminated siding panels 32 may be stacked and shipped to the construction site in a more economical fashion without concern for damage to the backerboard 30.

The rigidity provided by the addition of the laminated backer material permits the siding manufacturer to reduce the gauge or thickness of the siding panel without a resultant loss of product rigidity. This reduction in material thickness provides the manufacturer with a cost savings that nearly offsets the cost of the backer material.

The in-plant laminated siding and backer assembly provides the siding installer a labor savings since it is not necessary to install the separate pieces of backer material to the panel on the job site.

Using an in-site assembly process, the backerboard 30 is attached to the inside wall surfaces of the siding panel 32 by means of any suitable bonding adhesive, such as Nyabond LP-0033-4 or other adhesives which can be employed in the process, it being necessary that the adhesives or bonding material be anti-corrosive.

Figure 6:
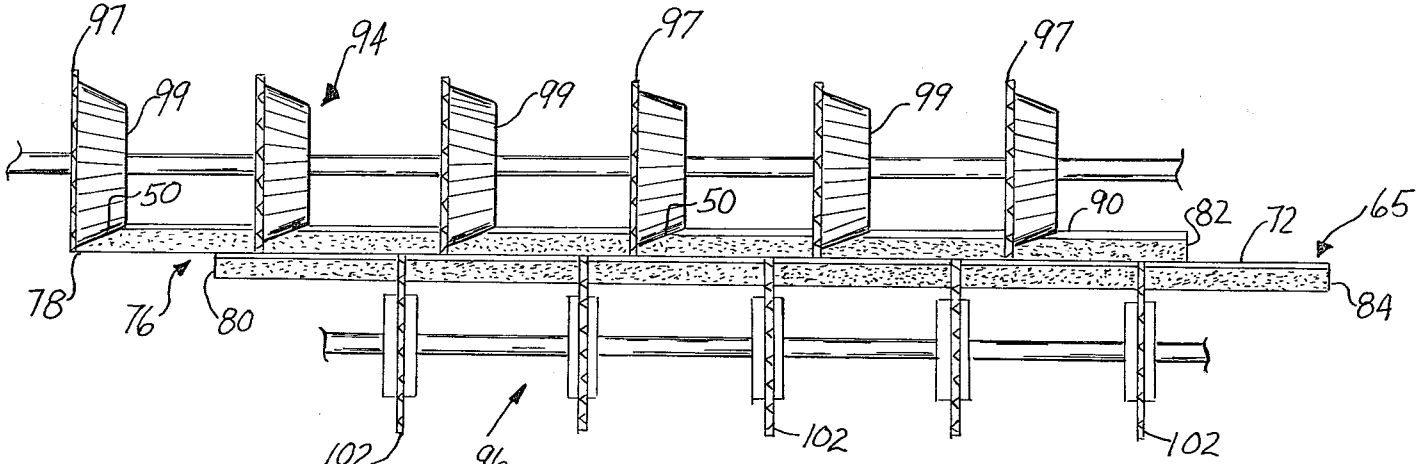
FIG. 6 is a fragmentary end view of the mechanism employed in fabricating the backerboard of the present invention as seen from Line 6–6 of FIG. 5.

Referring now to FIGS. 5 and 6 for a description of the preferred method of manufacturing the backerboard 30 described hereinbefore and illustrated in FIGS. 2, 3, and 4 of the drawings. FIG. 5 is a schematic illustration of an apparatus that may be employed to practice the inventive method for manufacturing the backerboard 30. The apparatus comprises a conveyor mechanism 60 having an endless conveyor belt 62 which is carried by rollers 64 (only one of which is shown) which are driven by any suitable motoring device. Station A of the apparatus comprises a stack of sheets 65 of insulating material. Preferably, the sheets 65 are polystyrene foam plastic sheets provided at the initial end of the conveyor belt 62 and are fed on to the conveyor belt by means of an appropriate feeder 66 in time relation to the movement of the conveyor belt 62. The sheets 65 are approximately 4 feet wide, 12 feet long, and ½ inch thick and are fed lengthwise onto the conveyor belt 62. As the conveyor belt 62 carries a sheet 65 of polystyrene foam plastic past station B, a plurality of laterally spaced glue applicators 70 apply a layer of glue to the upper face of the sheet 65. At station C a layer of aluminum foil 72 is applied to the upper face of the sheet 65 to completely cover the same, the aluminum foil 72 being securely pressed to the upper surface of the sheet 65 by means of a suitable roller device or the like, as indicated by the numeral 74.

At station D a plurality of glue applicators 75 are provided in laterally spaced relationship to apply a plurality of laterally spaced lengthwise strips of adhesive to the upper face of the aluminum foil 72. At station E a second stack of polystyrene foam plastic sheets 76 is provided. A sheet 76 is adapted to be positioned on the underlying sheet 65 as the same passes by. This is accomplished by a suitable feeder mechanism 78' which positions a sheet 76 on the underlying sheet 65 in timed relation to the movement of the sheet 65 thereby. As can best be seen in FIG. 6, the sheet 76 is laterally displaced with respect to the sheet 65 such that the lengthwise edge 78 of the upper sheet 76 is laterally displaced from the lengthwise edge 80 of the lower sheet 65 by a distance which is equal to the width of the siding panel wall 38, while the lengthwise edge 82 of the upper sheet 76 is laterally displaced inwardly from the lengthwise edge 84 of the lower sheet 65 by an equal distance.

Referring again to FIG. 5, as the two sheets 76 and 65 pass station F, suitable rollers 86 apply sufficient pressure to the sheet 76 so as to insure a proper bonding of the sheets 76 and 65 due to the adhesive which has been previously applied by the applicators 75 at station D.

At station G a plurality of laterally spaced glue applicators 88 provide an appropriate amount of adhesive to the upper surface of the sheet 76 such that a layer of aluminum foil 90 may be applied to the upper surface of the sheet 76 when the sheet passes by station H, while rollers 92 apply a sufficient pressure to the upper surface of the aluminum foil 90 to insure a proper bond. It should be noted that the lamination of the aluminum foil layers 72 and 90 is an additional insulation feature of the present invention; however, it is not necessary that the aluminum foil layer be employed in the manufacture of the backerboard 30.

At the final station J the joined polystyrene foam plastic sheets 65 and 76 pass by upper and lower cutting mechanisms, respectively, indicated by the numerals 94 and 96. The mechanism 94 has cutting blades 97 which function to cut the upper sheet 76 at laterally spaced locations equal to the width of the panel wall 38, while suitable cutting elements 99 carried by the upper cutting mechanism 94 are provided for forming the tapered edge 50 at the appropriate location along the full length of the sheet 76. At the same time cutters 102 carried by the cutting mechanism 96 function to cut the lower sheet 65 at laterally spaced locations equal to the width of the panel wall 34. It can thus be seen that the joined sheets 76 and 65 are cut in such a manner to form a plurality of finished backerboards 30 which have the appropriate and desired width, thickness, and length, as aforementioned.

It should be noted that the aluminum foil layers 72 and 90 may be positioned respectively on the plastic sheets 65 and 76 in strips in laterally spaced locations to form a backerboard 30', as illustrated in FIG. 4. This results in an economy of materials as less aluminum foil is used in that the interface between the members 42 and 44 and the tapered edge 50 is not coated with the foil.

It can be seen that the present invention has provided a new and improved backerboard particularly adapted for use in conjunction with siding panels adapted to be mounted to the exterior walls of a building.

It should also be noted that the present invention may be embodied in other specific forms without departing from the spirit or essential characteristics of the invention. As an example, the width of the sheets 76 and 65 may be varied so as to make more or less backer panels in the method described with respect to the embodiment illustrated in FIGS. 5 and 6. Additionally, the overall length of the members 42 and 44 of the backerboard 30 may also be varied as well as their thickness.

The present invention is therefore to be considered in all respects as illustrative and not restrictive, the scope of the invention being indicated by the appended claims rather than by the foregoing description, and other embodiments which come within the meaning and range of equivalency of the claims are therefore intended to be embraced thereby.

What is claimed is as follows:

1. A backerboard in a siding panel of the type having longitudinally disposed first and second walls connected by a longitudinal step wherein the siding panel is adapted to be fastened to the external wall sheathing of a building, and the backerboard is disposed between the inner surface of the siding panel wall and the exterior surface of said building, said backerboard comprising:

a first longitudinal member fabricated from a material having insulating qualities, said first member having a surface contour complementary to said first wall inner surface and abutting same;

a second longitudinal member fabricated from a material having insulating qualities, said second member having a surface contour complementary to said second wall inner surface and abutting same, said second member having a portion which overlaps a portion of said first member;

means fastening said overlapping portions of said first and second members such that the longitudinal edge of said first member adjacent said overlapping portions abuts the inner surface of said panel step when said backerboard is positioned in abutment with said panel wall inner surfaces.

2. The backerboard defined in claim 1 wherein said fastening means comprises an adhesive bonding said overlapping portions of said members to each other.

3. The backerboard defined in claim 1 wherein at least one surface of each of said first and second longitudinal members is laminated with a sheet of aluminum foil.

4. The backerboard defined in claim 1 wherein said first and second sheets are each fabricated from a molded polystyrene foam plastic.

5. The backerboard defined in claim 1 wherein said fastening means comprises an adhesive bonding said overlapping portions of said members to each other; a second adhesive for bonding the abutting surfaces of said first and second members respectively to the inner surfaces of said first and second panel walls; said first and second members being fabricated from a molded polystyrene foam plastic.

6. A backerboard defined in claim 1 further comprising means fastening said first and second members respectively to the inner surfaces of said first and second panel walls.

7. The backerboard defined in claim 6 wherein said last-mentioned means comprises an adhesive bonding said first and second members to said first and second wall panels.

* * * * *